United States Patent [19]

Gräther et al.

[11] 4,217,868

[45] Aug. 19, 1980

[54] IGNITION SYSTEM FOR INTERNAL COMBUSTION ENGINES, PARTICULARLY OF THE AUTOMOTIVE TYPE

[75] Inventors: Günter Gräther, Pinache; Friedrich Rabus, Schwieberdingen; Ewald Stuible, Eberdingen, all of Fed. Rep. of Germany

[73] Assignee: Robert Bosch GmbH, Stuttgart, Fed. Rep. of Germany

[21] Appl. No.: 882,788

[22] Filed: Mar. 2, 1978

[30] Foreign Application Priority Data

Mar. 16, 1977 [DE] Fed. Rep. of Germany ..... 2711432

[51] Int. Cl.[2] ..... F02P 5/04

[52] U.S. Cl. ..... 123/416

[58] Field of Search ..... 123/117 R, 117 D, 32 EB, 123/32 EC

[56] References Cited

U.S. PATENT DOCUMENTS

| | | | |
|---|---|---|---|
| 3,908,616 | 9/1975 | Sasayama | 123/117 D |
| 3,926,557 | 12/1975 | Callies et al. | 123/148 E |
| 3,941,103 | 3/1976 | Hartig | 123/117 D X |
| 4,018,202 | 4/1977 | Gartner | 123/117 D X |
| 4,068,631 | 1/1978 | Lombard et al. | 123/117 D |
| 4,082,069 | 4/1978 | Mayer | 123/117 D |
| 4,127,091 | 11/1978 | Leichle | 123/117 D |

*Primary Examiner*—Tony M. Argenbright

*Attorney, Agent, or Firm*—Frishauf, Holtz, Goodman & Woodward

[57] ABSTRACT

To accurately determine the dwell time as well as the ignition instant in a digitally controlled ignition system to provide essentially constant ignition energy to a spark plug, and permit ready adjustment and matching of a basic system to various types of internal combustion engines, a counter is controlled to count up at a rate depending on speed of the engine starting from a predetermined angular position of the crankshaft of the engine with respect to a piston, then count down at a second rate, which may be fixed; a fixed number is introduced into the counter which changes the count state during either the first or the second count cycle, or upon transition of counting from the first to the second count cycle, the determination of the number being readily changed by specific connection of output terminals from the counter to a decoding stage, thus avoiding the necessity of reconnecting the internal wiring of a group of gates to match the system to any given engine.

17 Claims, 4 Drawing Figures

IGNITION SYSTEM FOR INTERNAL COMBUSTION ENGINES, PARTICULARLY OF THE AUTOMOTIVE TYPE

CROSS REFERENCE TO RELATED PUBLICATIONS

U.S. Pat. No. 3,908,616;

German Disclosure Documents Nos. 2,606,890; 2,616,693; 2,619,556; and U.S. Ser. No. 798,331, now U.S. Pat. No. 4,138,977;

U.S. Ser. No. 799,247 filed May 23, 1977, now U.S. Pat. No. 4,162,665, July 31, 1979, both GRÄTHER et al, relating to extended spark systems assigned to the assignee of the present application.

German Document No. 2,616,693 is corresponding to U.S. Ser. No. 776,740 (Mar. 11, 1977).

The present invention relates to a digitally controlled electronic ignition system, and more particularly to an arrangement which is readily adaptable to different types of internal combustion engines without major interference in the wiring of the system.

BACKGROUND AND PRIOR ART

Various types of digital ignition systems have been proposed. The present system is a further development of the type of ignition system described in U.S. Pat. No. 3,908,616 Sasayama. This patent discloses a system in which a switch closes to permit current to flow through the primary of an ignition coil when a counter has reached a certain count state. The particular count state of the counter depends on the type of engine with which the system is used. A decoding stage is provided to decode the specific count state. Such decoding stages customarily include a plurality of logic gates. When such a system is to be matched to various types of internal combustion engines using different ignition coils and requiring different closed time periods for the switch to store the appropriate quantity of electromagnetic energy therein, in short, have different dwell times, to use the terminology customary with breaker-type systems, it is necessary to change the arrangement of the gates in the decoding system in order to match the dwell period or dwell time commanded by the system to the particular engine, while retaining the accuracy of setting of the ignition instant with respect to a predetermined angular crankshaft position. Changing the wiring or connection of gates in a decoding stage is labor-intensive and hence expensive.

THE INVENTION

It is an object to control the dwell time and the ignition instant in an electronic, digitally operating ignition control system in accordance with requirements placed thereon by external equipment, such as the internal combustion engine, its ignition coil, or the like, in a simple manner which does not require rewiring of gates or re-arranging of decoding stages.

Briefly, a bidirectional, up/down counter is provided which is controlled to count in two directions at respectively different rates; at a predetermined time instant during the counting cycle of the counter, the count state thereof is changed by a fixed numerical value $Z_I$. The ignition instant itself is triggered when the counter has reached a predetermined count state, preferably the count state of null or zero. The transducer system which controls the ignition system is so arranged that the transducer signal provided to the ignition system is advanced with respect to the ignition instant by a predetermined angle of rotation of the crankshaft of the engine.

Changes in the dwell time of the system can be easily obtained by changing the wiring to the count inputs of the counter, or of an adder stage used in connection therewith. The system also permits operation with proper dwell time up to the highest designed speeds of the engine by triggering the ignition event or ignition instant when the counter has reached a certain low, minimum value—preferably zero or null—thereby avoiding the danger which may occur in other systems that, at extremely high speed, the decoding value of a decoding stage connected to the counter is never reached, thus resulting in interruption of ignition. The ignition system, therefore, is versatile, can be used with different types of engines, and can readily be matched to different types of engines and different ignition coils and components used in connection therewith.

In a preferred form, the decoding stage is so connected to the count outputs of the counter that when the counter reaches zero or null, an electronic switch is commanded to be closed through a dwell time control system which controls the closed or dwell period of the switch. The dwell time control system may include a frequency generator to provide an extended spark with a plurality of arc-over events, the first one occurring at the predetermined ignition instant and subsequent arc-over events occurring rapidly thereafter to ensure complete combustion of all air-fuel mixtures in the combustion chamber of the internal combustion engine, thus providing for maximum use of the heat content of the fuel.

DRAWINGS, illustrating preferred examples

Figure 3:
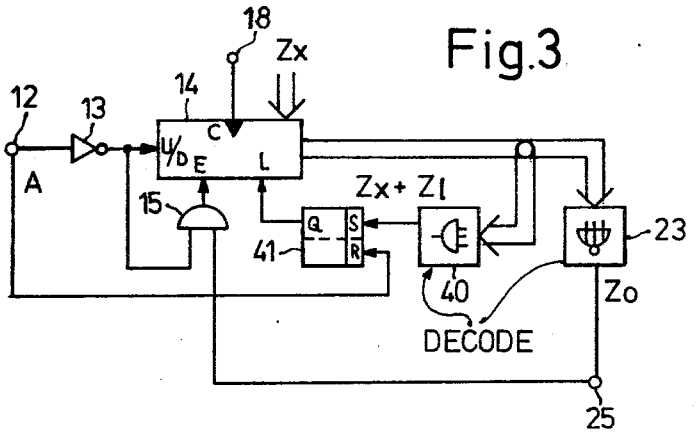
FIG. 3 is a fragmentary diagram illustrating another embodiment and a different way to trigger introduction of a fixed number into the counter.
Figure 4:
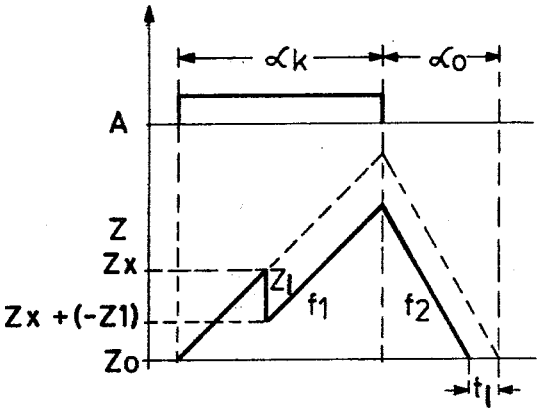

and FIG. 4 is a signal diagram illustrating the signals occurring in the system of FIG. 3.

The crankshaft of an internal combustion (IC) engine E is connected to a transducer 10. The transducer 10 is shown as an inductive transducer, but may be of any suitable type, for example a breaker-type transducer, a Hall generator, an optical transducer, or any other suitable ignition signal generator. The output from transducer 10 is connected to a wave-shaping stage 11, typically a Schmitt trigger. The transducer 10 can be associated, as known, with a mechanical ignition time adjustment system, for example an ignition advance arrangement, or may include an electronic ignition time adjustment system. Such systems, which are known in the Art, would be connected between the output of wave-shaping stage 11 and terminal 12. Terminal 12 is connected through an inverter 13 to the count direction control input of a counter 14, shown as the up-down count input labelled U/D. The counter 14 is a digital counter. The output of the inverter 13 is additionally connected to the count number input L, forming the loading input to the counter and to one input of an AND-gate 15. The output of AND-gate 15 is connected to the blocking input E of counter 14.

Terminal 12 is further connected through an AND-gate 16 to one input of an OR-gate 17, the output of which is connected to the clock input C of counter 14. Terminal 12 is additionally connected through an inverter 19 to one input of an AND-gate 20, the output of which is connected to another input of OR-gate 17. The AND-gates 16, 20 in combination with the OR-gate 17 operate, together, as a transfer switch to steer pulses to the count input C of counter 14 either from a frequency divider 22 connected to the other input of AND-gate 16, or directly from a frequency generator 21, connected to the other input of AND-gate 20. Frequency generator 21 provides pulses at a rate $f_2$; the divider 22 provides pulses divided from those of the generator 21 at a rate $f_1$. Rather than providing the combination of a frequency generator and a frequency divider, two frequencies could also be generated in equivalent manner by providing two synchronized frequency generators, or a single frequency generator providing different output frequencies, or other suitable arrangements.

The count outputs of the counter 14 are connected to a decoding stage 23. The count inputs of counter 14 are connected to an adder 24. The addition inputs of the adder stage 24 are available for access to hard wiring, so that the adder 24 can be wired to provide a fixed numerical value $Z_l$. The output of decoding stage 23 is connected to a terminal 25 which in turn is connected to a second input of AND-gate 15, and additionally to the input of a dwell time control stage 26. The dwell time control stage 26 is provided to control the closed time interval of a control switch in series with the primary of the ignition coil 28. The control switch is shown as a transistor 29. This closed time interval, or dwell time, must have a certain time duration to obtain essentially constant ignition energy across a spark gap, typically a spark plug 31. In a simple embodiment, the dwell time control stage 26 may merely be a monostable circuit. Preferably, the dwell time control stage 26 additionally includes a frequency generator to command triggering of a plurality of ignition sparks for any one ignition event. Systems to generate an extended band of ignition sparks are disclosed in German Disclosure Documents Nos. OS 2,606,890; 2,616,693; and 2,619,556. The output of the dwell time control stage is connected to the control input of the usual solid-state ignition control system 27, that is, to the base of transistor 29. Transistor 29, as such, may be a Darlington transistor or any other type of ignition control system. Preferably, a driver transistor is connected to transistor 29. The series circuit of the main switching path of transistor 29 and the primary of ignition coil 28 are connected between ground, chassis, or reference potential R and a source of electrical power, typically the positive terminal of a battery, for example the battery of an automotive vehicle, shown at 30. The junction of the primary of ignition coil 28 and the switch 29 is connected to the secondary of the ignition coil which, in turn, is connected to spark plug 31; for a multi-cylinder engine, a distributor can be interposed between the secondary of the ignition coil and the spark plugs, as well known.

Figure 2:
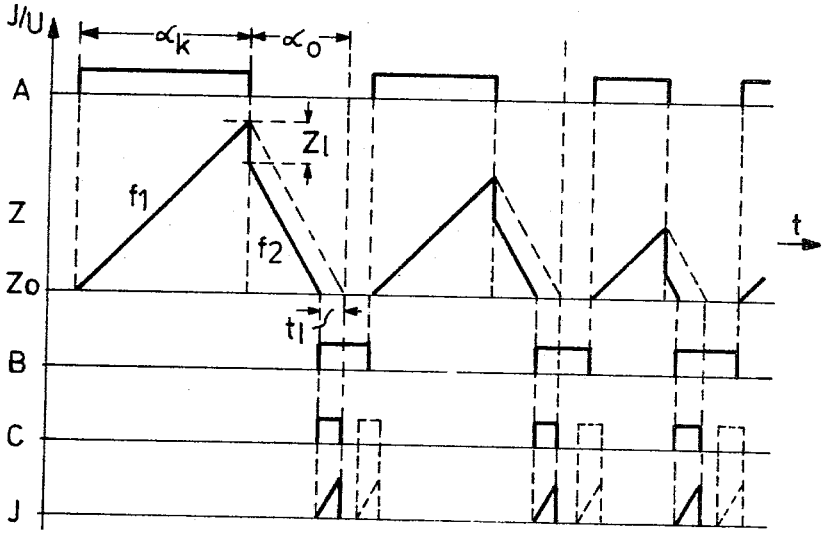
FIG. 2 is a signal diagram of signals arising in the system of FIG. 1.

Operation, with reference to FIG. 2: The system will be explained by using customary digital notations; a 1-signal is defined as a signal of approximately positive supply voltage, a 0-signal a signal of approximately reference level voltage.

Figure 1:
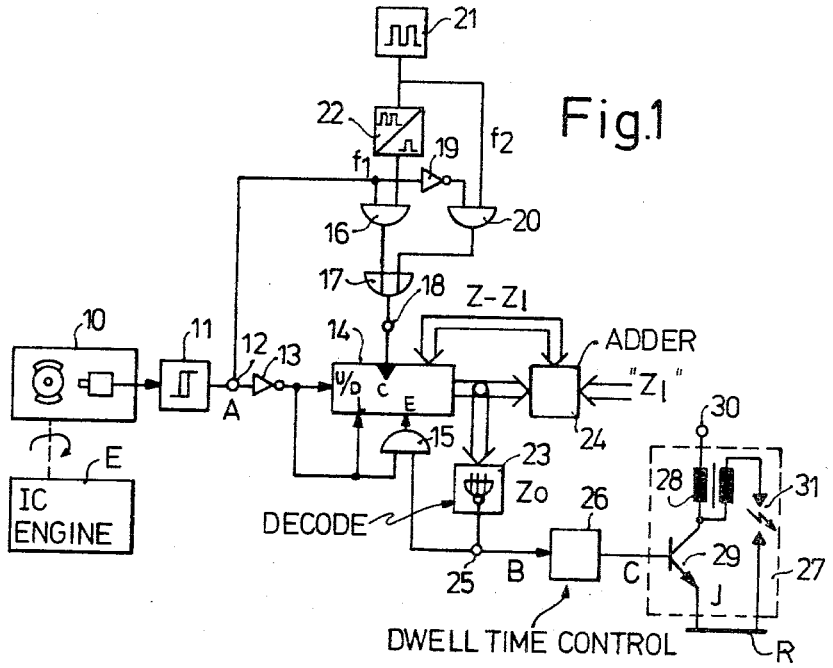
FIG. 1 is a block diagram of the system utilizing an adder stage.

Upon rotation of the crankshaft of the engine, the transducer 10 will provide a signal to terminal 12 during a fixed angle of rotation $\alpha_k$, as seen in graph A of FIG. 2. FIG. 1 has been labelled to indicate, by letters, the signals shown in FIG. 2 at the points or junctions where they arise. In a four-cylinder engine, $\alpha_k$ preferably corresponds to about a quarter revolution of the crankshaft. The end of the angular segment $\alpha_k$ is advanced by an angle $\alpha_o$ before the desired ignition instant. This may be a fixed instant, or a computed instant, or an analog-commanded ignition instant. The advance by angle $\alpha_o$ can be obtained by offsetting or rotating the transducer 10 with respect to the crankshaft position corresponding to top dead center (TDC) position of a piston of the engine. During the occurrence of the signal A, counter 14 is commanded to count up by application of the signal A through inverter 13 to the U/D input thereof. The AND-gate 20 is blocked due to inverter 19, the AND-gate 16 is open for clock signals $f_1$ which are applied through OR-gate 17 to the count input C of counter 14. The counter 14 thus will count during occurrence of the signal A with the frequency $f_1$. When the signal A ends, the count direction input U/D switches over and the counter, from then on, will count down. The AND-gate 16 blocks, AND-gate 20 opens, and clock signals $f_2$ can now be applied to the count input C. The leading flank of the change-over signal applied to the U/D input is likewise applied to the load input L, which will cause transfer of the number Zl from the adder into the counter so that the count state in the counter will be decremented by the number Zl. Thus, the counter will have the number Z−Zl appear therein. Z is that number which appears at the count output of the counter 14 at the termination of the signal A. The count state of counter 14 thus jumps downwardly by a predetermined value, determined by the number Zl. The counter will then count downwardly at the rate of $f_2$, provided directly by the generator 21 through AND-gate 20, that is, at a faster rate than the charging rate, as illustrated by the differences in steepness of slope in FIG. 2. The counter counts downwardly until it reaches the value Zo of null or zero. Decoding stage 23 recognizes when the counter has counted down to zero and provides an output signal B. The outut signal B is fed back through the AND-gate 15 to block the counter 14 and prevent further down-counting. AND-gate 15 will be conductive at that point since a 1-signal is applied thereto through inverter 13. The signal B is additionally applied to the dwell time control stage 26 which will cause transistor 29 to become conductive, causing in turn a rise in current flow, signal J, through the primary of ignition coil 28. The duration of the signal C from the dwell time control determines the closed time period or time interval of transistor 29. When the appropriate amount of electromagnetic energy has been stored in ignition coil 28, transistor 29 is caused to block. The abrupt interruption of current flow through the primary of ignition coil 28 will induce a high-voltage pulse, causing arc-over at spark plug 31. The dwell time control system can be so arranged that, after a predetermined open time interval, it again closes so that one or more additional sparks will be generated. Since this is not a necessary feature, the additional signal C for extended spark ignition and the current flow J are shown in broken lines in FIG. 2.

The adder stage 24 is provided to receive the output numerical value Z to which counter 14 has counted during the up-count and to algebraically combine it with the value of the number −Zl, so that the count input of the counter 14 always will have the number Z−Zl applied thereto which can be transferred into the counter 14 when a load signal is applied to the L input of the counter 14.

The relationship of the two frequencies is determined by the relationship $f_2/f_1=\alpha_k/\alpha_o$. The desired closing time $t_1$ is controlled or commanded by the dwell time control stage 26. The beginning of the closing of the switch 29, that is, commencement of operation of stage 26, is determined by the fixed number Zl. The relationship $Zl=f_2 \cdot t_1$ governs. The number Zo, which starts the closing time of the dwell time control 26, can be selected, as a general principle, to be any number. Preferably, the number should be very low, however, and in the most preferred form, the lowest possible count of the counter, that is zero or null, is particularly suitable.

Embodiment of FIG. 3: The circuit between terminals 12, 18 and 25 of FIG. 3 differs from that of FIG. 1; the remainder of the circuit is the same; thus, elements 10, 11, 16 to 22 and 26 to 31 are to be considered as forming part of the system of FIG. 3. Similar components have been given the same reference numerals and will not be described again, unless their function differs. The adding stage 24 is eliminated; the count outputs of the counter 14 are connected not only to decoding stage 23 but to a second decoding stage 40, the output of which is connected to the SET input of a flip-flip (FF) 41. The Q of output of FF 41 is connected to the load input L of counter 14. The RESET input R of FF 41 is connected to terminal 12. The count input of counter 14 has a fixed value Zx applied thereto; the count number of Zx is preferably determined by hard wiring of count output terminals of counter 14.

Operation of embodiment of FIG. 3, with reference to FIG. 4: Counter 14 counts upwardly during the occurrence of the signal A with a frequency $f_1$. When the count number Zx+Zl is reached, decoding stage 40 provides an output signal which sets FF 41. The signal at the L input causes transfer of the number Zx, in negative direction, into the counter to set the counter down by the number Zx. When the counter next reaches the count value Zx+Zl, the decoding stage 40 again provides an output signal which, however, is not transferred by the FF 41 since FF 41 remains SET. The counter then continues to count for the remaining duration of the signal A. Change-over from up-counting to decrementing or down-counting at the frequency $f_2$ is done in the same manner as explained in connection with FIGS. 1 and 2. When the count number Zo, that is, a predetermined number which, preferably is zero, is reached, decoding stage 23 decodes this number and provides an output signal which over terminal 25 triggers the dwell time control to initiate charging of electromagnetic energy into the ignition system 27 to generate a spark. When the next A signal appears at terminal 12, FF 41 is reset.

The decrementing of the counter 14 by the number Zl can occur at any time in the cycle; as a general principle of the invention, the time occurrence of the decrementing of the counter is not relevant. For example, in the embodiment of FIG. 1, the load input L of the counter could have another signal applied thereto which occurs at another instant of time. Similarly, as explained in the second example (FIG. 3), the instant of time of resetting or decrementing the counter can be done at any desired instant by suitable choice of the numerical values Zx or Zl and, respectively, Zx+Zl. Thus, the reset or decrementing time instant can be shifted within the cycle. The numerical value Zo preferably utilizes the lowest possible count state of the counter 14, in the most suitable embodiment a count stage of null or zero. The number Zx can be selected to be identical with the numerical value Zo. This would require an additional gate which prevents that the dwell time control 26 is energized already at the instant when the counter is being reset.

Various other changes and modifications may be made. For example, an equivalent embodiment of the invention could utilize a counter 14 which first counts down and then in a subsequent sequence counts up. The number Zl then must be entered in the reverse algebraic sense with respect to that described in connection with the example as shown. Other changes and modifications may likewise be made, and features described in connection with one of the embodiments may be used with the other, within the scope of the inventive concept.

We claim:

1. An ignition system for an internal combustion engine (E) comprising an ignition coil (28);

a controlled switch (29) serially connected with the primary of the ignition coil;

a transducer means (10) rotating with the shaft of the engine (E) and providing an ignition control signal (A) and located relative to the shaft of the engine (E) to provide said ignition control signal to occur at an angular position ($\alpha_o$) of the shaft of the engine in advance of the angular position of the shaft when an ignition event is to occur a counter (14) controlled by the ignition control signal and counting, cyclically, under control of said ignition control signal to provide a speed-dependent count number;

means (21, 22) generating at least two pulse trains of different frequencies to control the counting rate of the counter, fixed decoding means (23) decoding the final count of the counter, and controlling the controlled switch (29);

counting setting means (24;Zx) acting on the counter (14) independently of the decoding means during a counting cycle thereof and modifying the count number appearing in the counter as a result of counting at the rate of at least one of said frequencies during said ignition control signal;

a dwell time control (26) connected between said decoding means (23) and the controlled switch (29) and determining the closing time of said controlled switch, the count number ($Z_l$) introduced to the counter (14) by said count setting means being defined by $$Z_l=f \cdot t_1$$

wherein $Z_l$ defines said count number; $t_1$ is the dwell time of said dwell time control; and f is the frequency of the pulse train then being connected to and controlling the counting rate of the counter (14);

wherein the count setting means includes an adder (24) connected to the counter (14) to add, algebraically, said count number ($-Z_l$) to the count state of the counter;

and transfer control means (L) connected to the counter to enter the summed value of the adder state to the then existing count state of the counter under control of said ignition control signal (A).

2. System according to claim 1, wherein said ignition control signal (A) defines a predetermined angle of rotation ($\alpha_k$) of the crankshaft of the engine (E);

switching means (16, 17) connecting the output defining one of said pulse trains of one frequency ($f_1$) of said pulse generating means to the counter to cause the counter to count in one direction at the rate of said frequency as controlled by said control signal;

and second switching means (19, 20, 17) connecting the output defining the other of said pulse trains of the other frequency ($f_2$) of said pulse generating means (21, 22) to the counter (14) to cause the counter to count in the opposite direction at the rate of said other frequency.

3. System according to claim 2, wherein the relationship of angular displacement of the crankshaft of the engine to the frequencies is defined by:

$$f_2/f_1=\alpha_k/\alpha_o$$

wherein $f_1$ is the frequency of the first pulse train; $f_2$ is the frequency of the second pulse train; $\alpha_k$ is a first predetermined angle of rotation of the crankshaft of the engine; and $\alpha_o$ is a second and succeeding predetermined angle of rotation of the crankshaft which defines a limiting position in advance of the angular position of the shaft when the ignition event is to occur.

4. System according to claim 1, wherein the count setting means (24) is acting on said counter (14) to modify the count number thereof while the counter is counting in the count direction of the first frequency ($f_1$).

5. System according to claim 1, wherein the count setting means (24) is acting on said counter (14) to modify the count number thereof while the counter is counting in the count direction of the second frequency ($f_2$).

6. System according to claim 1, wherein the decoding means (23) is connected to a predetermined number output (Zo) of the counter (14);

and a dwell time control means (26) connected between the decode means and said controlled switch (26) to provide for a predetermined closing or dwell time of said controlled switch after receiving a signal from said decoding means (23).

7. System according to claim 6, wherein the predetermined count number (Zo) of the counter (14) is the minimum count state thereof.

8. System according to claim 7, wherein said minimum count state is null or zero.

9. System according to claim 6, wherein said dwell time control means (26) comprises a timing circuit.

10. System according to claim 6, wherein said dwell time control means include a frequency generator to provide a plurality of timing intervals to control repetitive closing, opening, reclosing and reopening of said controlled switch (29) and thereby generate an extended spark band.

11. System according to claim 1, wherein said modifying count number (Zl) is zero.

12. System according to claim 1 wherein the counter (14) is a bidirectional counter and two pulse trains are generated by said pulse trained generating means (20, 21), one pulse train of a first frequency ($f_1$) controlling the up count of the counter and the second pulse train of a second frequency ($f_2$) controlling the down count of the counter;

and wherein the count setting means (24) act on said counter (14) to modify the count number thereof while the counter is counting in the up-count direction at the rate of the first frequency ($f_1$).

13. System according to claim 1 wherein the counter (14) is a bidirectional counter and two pulse trains are generated by said pulse trained generating means (20, 21), one pulse train of a first frequency ($f_1$) controlling the up count of the counter and the second pulse train of the second frequency ($f_2$) controlling the down count of the counter;

and wherein the count setting means (24) act on said counter (14) to modify the count number thereof while the counter is counting in the down-count direction at the rate of the second frequency ($f_2$).

14. System according to claim 1 wherein the counter (14) is a bidirectional counter and two pulse trains are generated by said pulse trained generating means (20, 21), one pulse train of a first frequency ($f_1$) controlling the up count of the counter and the second pulse train of the second frequency ($f_2$) controlling the down count of the counter;

and wherein the count setting means (24) sets the counter to modify the count number thereof at the termination of the counting in the up counting direction.

15. An ignition system for an internal combustion engine (E) comprising an ignition coil (28);

a controlled switch (29) serially connected with the primary of the ignition coil;

a transducer means (10) rotating with the shaft of the engine (E) and providing an ignition control signal (A) and located relative to the shaft of the engine (E) to provide said ignition control signal to occur at an angular position ($\alpha_o$) of the shaft of the engine in advance of the angular position of the shaft when an ignition event is to occur a counter (14) controlled by the ignition control signal and counting, cyclically, under control of said ignition control signal to provide a speed-dependent count number;

means (21, 22) generating at least two pulse trains of different frequencies to control the counting rate of the counter, fixed decoding means (23) decoding the final count of the counter, and controlling the controlled switch (29);

count setting means (24;Zx) providing a fixed number ($Z_l$) acting on the counter (14) independently of the decoding means during a counting cycle thereof and modifying the count number appearing in the counter as a result of counting at the rate of at least one of said frequencies during said ignition control signal said ignition control signal (A) defining a predetermined angle of rotation ($\alpha_k$) of the crankshaft of the engine (E);

fast switching means (16, 17) connecting the output defining one of said pulse trains of one frequency ($f_1$) of said pulse generating means to the counter (14) to cause the counter to count in one direction at the rate of said frequency as controlled by said control signal;

second switching means (19, 20, 17) connecting the output defining the other of said pulse trains of the other frequency ($f_2$) of said pulse generating means (21, 22) to the counter (14) to cause the counter to count in the opposite direction at the rate of said other frequency;

the relationship of angular displacement of the crankshaft of the engine to the frequencies being defined by:

$$f_2/f_1 = \alpha_k/\alpha_o$$

wherein $f_1$ is the frequency of the first pulse train; $f_2$ is the frequency of the second pulse train; $\alpha_k$ is a first predetermined angle of rotation of the crankshaft of the engine; and $\alpha_o$ is a second and succeeding predetermined angle of rotation of the crankshaft which defines a limiting position in advance of the angular position of the shaft when the ignition event is to occur;

means (26) controlling the dwell time to be fixed, connected between said decoding means (23) and the controlled switch (29) and determining the closing time thereof;

a further decoding means (40), decoding when the counter reaches a number larger (Zx) than said fixed count number ($Z_l$) and, upon reaching said larger number, transferring said count number ($Z_l$) into the counter (14);

and means (41) connected to and controlled by the counter inhibiting a repeated entry of said modifying count number ($Z_l$) into the counter, after having once been entered thereinto, during any counting cycle.

16. System according to claim 15, wherein said predetermined count state of the counter is zero.

17. System according to claim 15 wherein the counter (14) is a bidirectional counter and two pulse trains are generated by said pulse trained generating means (20, 21), one pulse train on a first frequency ($f_1$) controlling the up count of the counter and the second pulse train of a second frequency ($f_2$) controlling the down count of the counter;

further including transfer control means (L) connected to the counter to enter a number determined by said count setting means (24) to the then existing count state of the counter.

* * * * *

UNITED STATES PATENT AND TRADEMARK OFFICE

CERTIFICATE OF CORRECTION

PATENT NO. : 4,217,868

DATED : August 19, 1980

INVENTOR(S) : Gunter GRATHER

It is certified that error appears in the above-identified patent and that said Letters Patent are hereby corrected as shown below:

Claim 4, line 4 (column 7) line 32, after "direction" insert -- and at the rate --

Claim 5, line 4 (column 7) line 36, after "direction" insert -- and at the rate --

Signed and Sealed this

*Seventeenth* Day of *February 1981*

[SEAL]

*Attest:*

RENE D. TEGTMEYER

*Attesting Officer*

*Acting Commissioner of Patents and Trademarks*